United States Patent [19]

Bartley

[11] Patent Number: 4,928,471

[45] Date of Patent: May 29, 1990

[54] GRATING CONSTRUCTION

[75] Inventor: David W. Bartley, Canton, Ohio

[73] Assignee: Ohio Gratings, Inc., Canton, Ohio

[21] Appl. No.: 203,265

[22] Filed: Jun. 8, 1988

[51] Int. Cl.[5] ..... E04C 2/42

[52] U.S. Cl. ..... 52/664; 52/666; 52/667; 52/668

[58] Field of Search ..... 52/664, 666, 667, 668

[56] References Cited

U.S. PATENT DOCUMENTS

| | | | |
|---|---|---|---|
| 1,354,998 | 10/1920 | Paulson | 52/667 |
| 1,573,154 | 2/1926 | Gelder | 52/667 |
| 2,246,766 | 6/1941 | Tarof | 52/668 |
| 2,257,105 | 3/1942 | Greulich | 52/667 |
| 2,437,186 | 3/1948 | Collins | 52/667 |
| 3,057,271 | 10/1962 | Butler et al. | 52/666 X |
| 3,391,513 | 7/1968 | Jones | 52/668 |
| 4,102,102 | 7/1978 | Greulich | 52/668 X |
| 4,522,009 | 6/1985 | Fingerson | 52/667 |
| 4,661,245 | 4/1987 | Rutherford et al. | 52/668 X |

FOREIGN PATENT DOCUMENTS

| | | | |
|---|---|---|---|
| 2043500 | 3/1972 | Fed. Rep. of Germany | 52/667 |
| 736343 | 6/1943 | German Democratic Rep. | 52/664 |

OTHER PUBLICATIONS

IKG "X-Bar" Steel and Aluminum Grating, p. 8, of a Product Catalog Offered by IKG Industries, a Division of Harsco Corp.

Pages 10 and 11 of a Product Catalog Offered by Bordon Metal Products Co.

*Primary Examiner*—David A. Scherbel
*Assistant Examiner*—Lan Mai
*Attorney, Agent, or Firm*—Michael Sand Co.

[57] ABSTRACT

An improved grating construction of the type intended for closing or flooring an opening. The construction preferably is formed of aluminum and includes a plurality of spaced, parallel, elongated bearing bars and a plurality of spaced, parallel, elongated, transversely extending crossbars. Each bearing bar has a generally flat, rectangular shape and has a plurality of spaced cutouts formed along a top longitudinal edge thereof. Each cutout comprises an upper rectangular-shaped portion and an outwardly flared lower portion. Each crossbar has a rectangular-shaped top portion and an outwardly flared lower portion, which portions are complementary in shape and size to the upper and lower portions of the bearing bar cutouts. The crossbars are slideably received within a plurality of transversely aligned bearing bar cutouts. The crossbars are deformed or swaged at locations adjacent to and on opposite sides of the cutouts engaged by the crossbars to lock the crossbars in the bearing bars to form the grating. The matching of the shape and size of the crossbar with that of the bearing bar cutouts enables the top surface of the crossbars to be substantially flush with the longitudinal top edges of the bearing bars which provides a generally flat surface for unobstructed walking or other movement on the grating.

5 Claims, 3 Drawing Sheets

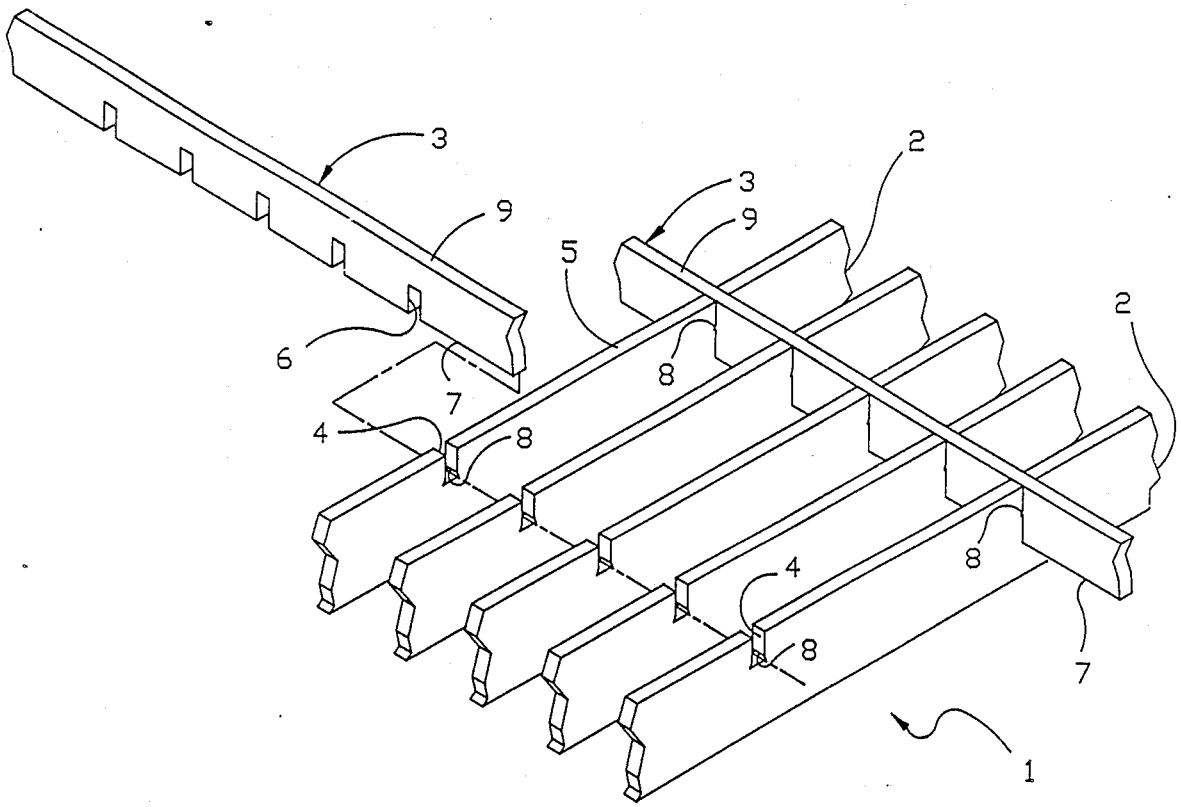
FIG. 1 – PRIOR ART
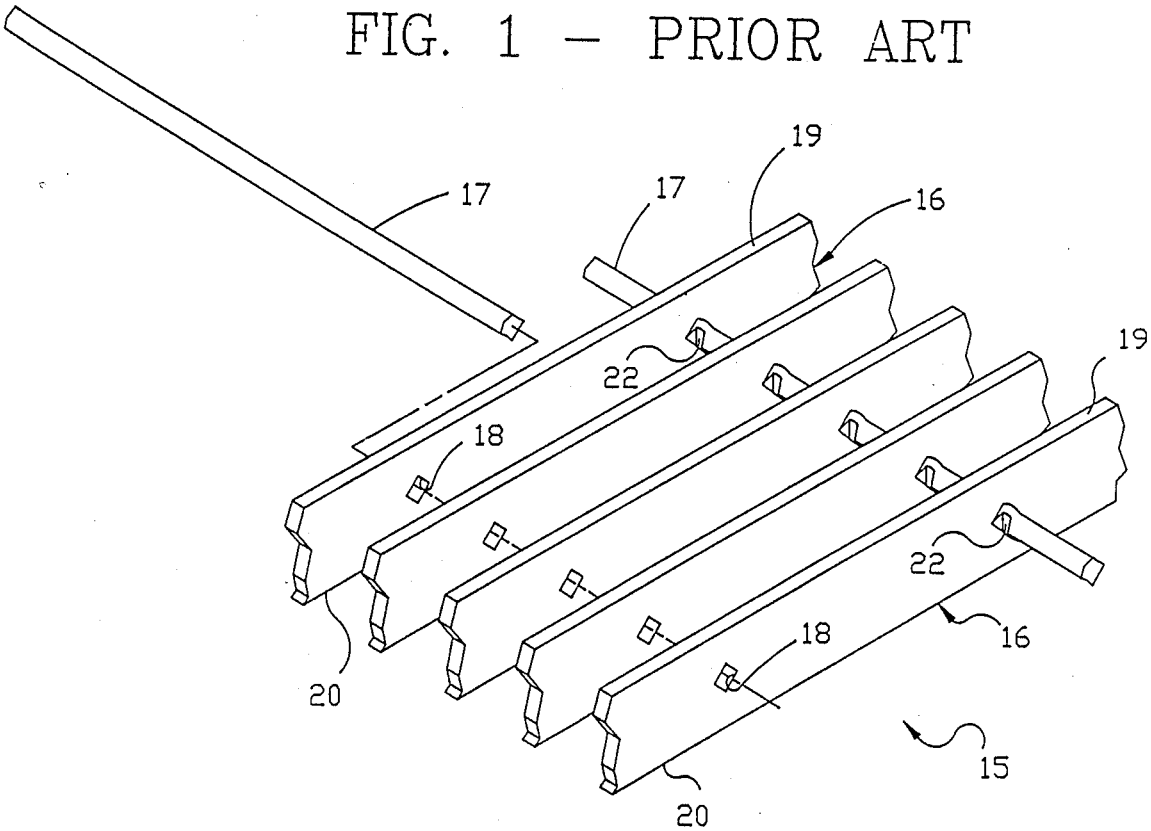
FIG. 2 – PRIOR ART

GRATING CONSTRUCTION

TECHNICAL FIELD

The invention relates to grating and in particular to an improved grating construction of the type intended for closing or flooring an opening. More particularly, the invention relates to an improved grating construction in which the assembled components are swage locked for structural integrity and form a generally level grating surface for unobstructed walking or other movement on the grating.

BACKGROUND ART

Grating has been used for many years in structural applications such as for areas of pedestrian traffic, catwalks, work platforms, etc. In addition to structural grating applications, many architects find grating attractive for architectural grillework, screens, dividers, etc. Thus, it can be seen that grating is ideal for a wide range of indoor and outdoor applications.

In most applications, grating is used to provide for the maximum passage of heat, light and air. However, the desirability of such maximum passage must be balanced against the necessity of having a strong, rigidly constructed and safe grating assembly for a particular application, especially where failure of the grating could cause serious personal injury and/or property damage.

The closest known prior art includes two types of grating construction which, although satisfactory for many applications, do not perform satisfactorily when used in certain other applications. The first type of prior art grating construction is pressure-locked grating which comprises crossbars pressed into bearing bars under hydraulic or mechanical pressure to force the crossbars into slots formed in the bearing bars. Although pressure locked grating performs satisfactorily for many applications and features a level grating surface formed by the crossbars and bearing bars, pressure locked grating generally is not as structurally sound or as economical to manufacture as my improved grating construction.

The second type of prior art grating construction comprises crossbars which are slideably mounted within apertures formed in the bearing bars. The crossbars then are swaged on both sides of each bearing bar to secure the crossbars firmly in the bearing bars to form the grating. Although swage locked grating also performs satisfactorily in many applications and is one of the sturdiest and safest types of grating constructions, it has one main disadvantage. The crossbars of the grating are mounted beneath the top surface of the bearing bars and do not form a level grating surface with the bearing bars. Also, these lowered crossbars are difficult to see in certain applications. Thus, although this type of swage locked grating is, in fact, sturdy and safe, it may not appear so to a person walking on the grate or using the grating due to the manner of engagement of the crossbars with the center of the bearing bars. That is, it appears to a person walking on this type of grating that the bearing bars are the sole means of support. Psychologically, seeing crossbars which form a level grating surface with the bearing bars gives a greater feeling of security to a person using the grating since he or she can actually see that the crossbars, as well as the bearing bars, are interconnected to form a rigid support. Furthermore, having crossbars which form a level grating surface with the bearing bars eliminates some of the risk of objects, such as bike tires, becoming lodged between the bearing bars.

Therefore, the need has existed for a grating construction which is strong, rigid and safe, which is economical to manufacture, and which includes crossbars which are swage locked with the bearing bars of the grating in such a manner as to form a level grating surface with the bearing bars. There is no known grating construction of which I am aware which accomplishes these results other than my invention which is described in detail below.

DISCLOSURE OF THE INVENTION

Objectives of the invention include providing an improved grating construction having crossbars which are swage locked with the bearing bars to form a level, uniform and easy to maintain grating surface.

Another objective is to provide such an improved grating construction which permits adequate amounts of heat, light and air to pass through the openings formed between the crossbars and bearing bars, and which performs satisfactorily in both structural and architectural applications.

A further objective is to provide such an improved grating construction which is strong, rigid, durable and safe in use, which can be quickly and economically manufactured, which is resistant to harsh conditions, which is aesthetically pleasing, and which provides a feeling of security to an individual walking on or otherwise using the grating.

These objectives and advantages are obtained by the improved grating construction of the invention of the type intended for closing or flooring an opening, the general nature of which may be stated as including, a plurality of spaced, parallel, elongated bearing bars, each having a plurality of spaced cutouts formed along a longitudinal top edge thereof, the cutouts each comprising a generally rectangular-shaped upper portion and an outwardly flared lower portion; a plurality of spaced, parallel, elongated crossbars, each having a generally rectangular-shaped upper portion and an outwardly flared lower portion, complementary in shape and size to the upper and lower portions, respectively, of the bearing bar cutouts, the crossbar being slideably engaged within a plurality of transversely aligned bearing bar cutouts; and metal deformations formed on the crossbars adjacent to the bearing bars for locking the bearing bars with the crossbars so that an upper surface of the rectangular portions of the crossbars are generally flush with the longitudinal top edges of the bearing bars.

BRIEF DESCRIPTION OF THE DRAWINGS

Preferred embodiments, illustrative of the best modes in which applicant has contemplated applying the principles, are set forth in the following description and are shown in the drawings and are particularly and distinctly pointed out and set forth in the appended claims.

FIG. 1 is a partially exploded, fragmentary perspective view, of a prior art pressure locked grating construction;

FIG. 2 is a partially exploded, fragmentary perspective view, of a prior art swage locked grating construction;

Similar numerals refer to similar parts throughout the drawings.

BEST MODE FOR CARRYING OUT THE INVENTION

Figure 3:
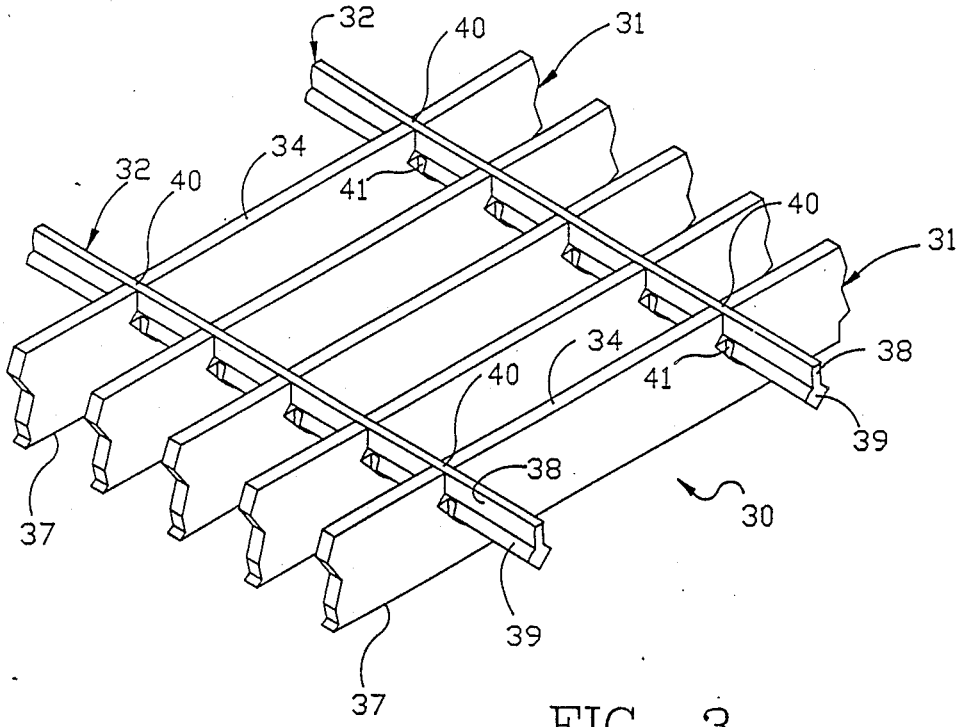
FIG. 3 is a fragmentary perspective view of the improved grating construction of the present invention.

The closest known prior art to the present invention includes pressure locked and swage locked grating constructions shown in FIGS. 1 and 2, respectively. These prior art grating constructions are used for a wide range of indoor and outdoor structural and architectural applications, such as supports for areas of pedestrian traffic, catwalks, work platforms, grillework, screens, dividers, etc.

A prior art pressure locked grating construction is indicated generally at 1 and is shown in FIG. 1. Grating construction 1 includes a plurality of spaced, parallel, elongated bearing bars 2 and a plurality of spaced, parallel, transversely extending elongated crossbars 3. Bearing bars 2 and crossbars 3 are formed of any suitably strong and rugged material such as steel or aluminum. Each bearing bar 2 is generally flat and rectangular-shaped, and has a plurality of spaced, slightly dovetail-shaped slots 4 formed along a longitudinal edge 5 thereof. Each crossbar 3 is generally flat and rectangular-shaped, and has a plurality of spaced, rectangular-shaped slots 6 formed along a first longitudinal edge 7 thereof.

Bearing bars 2 and crossbars 3 of pressure locked grating 1 are assembled in the following manner. Rectangular slots 6 of each crossbar 3 are slideably engaged with transversely aligned ones of dovetail slots 4 of bearing bars 2. Crossbars 3 then are pressed into bearing bars 2 under hydraulic or mechanical pressure and deformed, wherein a small amount of the crossbar material is forced laterally into a pair of notches 8 at the base of dovetail slots 4. Thus, bearing bars 2 and crossbars 3 are pressure locked into a single unit or grating construction 1.

Dovetail slot 4 preferably is one-half the depth of crossbar 3, which itself is slotted to a depth slightly less than one-half of its depth, so that when bars 2 and 3 are pressed together under hydraulic or mechanical pressure forcing a portion of the crossbar material into notches 8 of slots 4, a second longitudinal edge 9 of crossbar 3 is substantially flush with longitudinal edges 5 of bearing bars 2. Thus, a level grating surface for unobstructed walking or other movement on the grating is provided.

The prior art swage locked grating construction is indicated generally at 15, and is shown in FIG. 2. Grating construction 15 includes a plurality of spaced, parallel, elongated bearing bars 16 and a plurality of spaced, parallel, transversely extending, elongated crossbars 17. Bearing bars 16 and crossbars 17 are formed of any suitably rugged material such as steel or aluminum. Each bearing bar 16 is generally flat and rectangular-shaped and has a plurality of spaced, square or diamond-shaped openings 18 formed therein. Each opening 18 is centered generally between longitudinal edges 19 and 20 of bearing bars 16. Each crossbar 17 is square or diamond-shaped and generally complementary in shape and size to opening 18 and is slideably engaged within transversely aligned bearing bar openings 18.

Grating construction 15 is assembled by slideably inserting crossbar 17 through a plurality of transversely aligned openings 18 of bearing bars 16. Each crossbar 17 is swaged at 22 on opposite sides of each opening 18 to lockingly engage the crossbars with the bearing bars by forcing crossbar material into the openings.

Although insertion of crossbars 17 through openings 18 of bearing bars 16 together with the swaging of the crossbars for locking the bars together provides a strong, rigid, durable and safe grating construction, the intersection of the crossbars through a center portion of the bearing bars prevents formation of a flat grating top surface comprised of the crossbars and bearing bars. Thus, to a person walking on or otherwise using the grating, it appears that his or her sole means of support underfoot is the bearing bars. In fact, the crossbars may not even be visible in certain grating applications. Therefore, from a psychological standpoint, many individuals will feel less secure walking on grating construction 15 than on grating construction 1 due to the different positioning of the crossbars relative to the bearing bars in these two types of grating constructions. Thus, even though the swage locked grating is more structurally sound than gratings assembled by pressure locking, an individual may actually feel a greater sense of security when he or she is supported by pressure locked grating due to its appearance.

Although both of the above-described types of prior art grating constructions perform satisfactorily in many applications, the need exists for a grating construction in which the crossbars are swage locked with the bearing bars in such a manner that the crossbars and bearing bars together form a level top surface.

Figure 4:
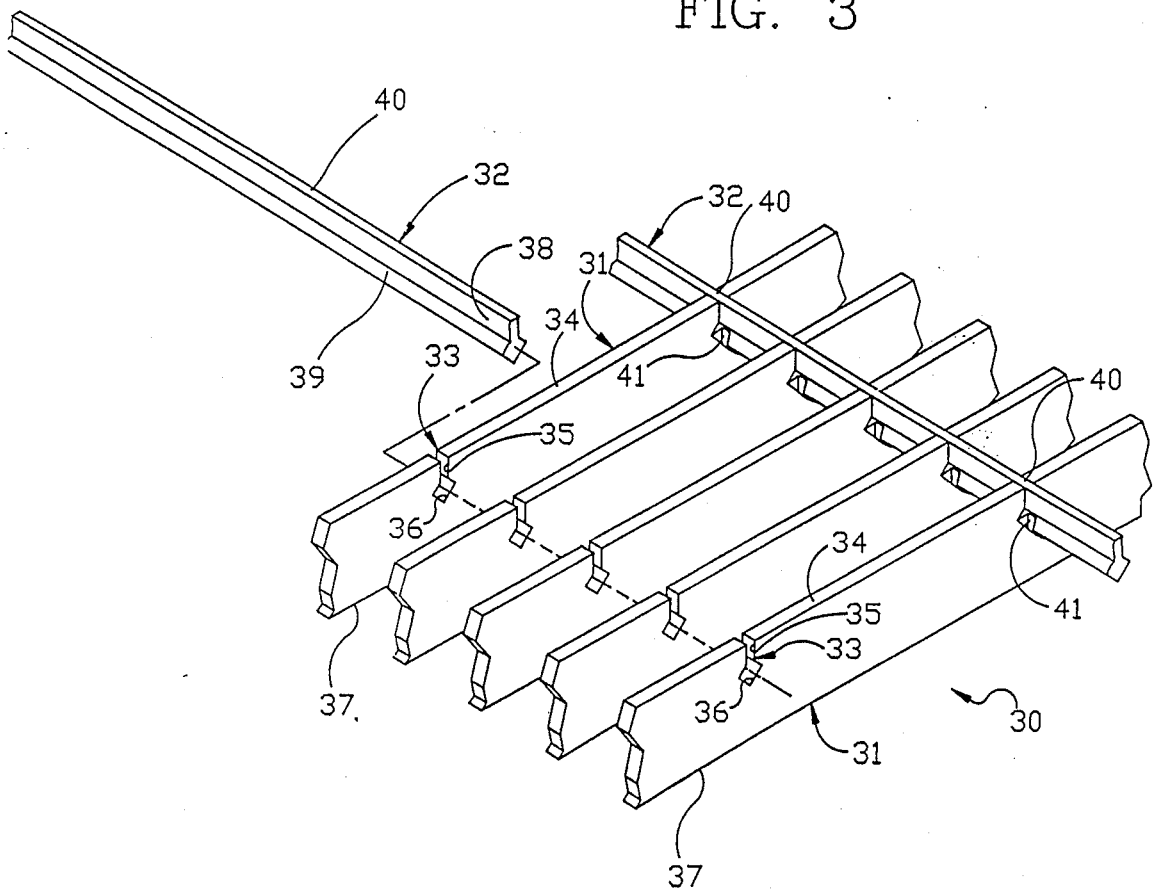
FIG. 4 is a partially exploded, fragmentary perspective view of the improved grating construction.

The improved grating construction of the present invention is indicated generally at 30, and is shown particularly in FIGS. 3 and 4. Grating construction 30 is generally intended for closing or flooring an opening, and more specifically can be used for a wide range of indoor and outdoor structural applications such as for areas of pedestrian traffic, catwalks, work platforms, and grills. Furthermore, grating construction 30 is likewise ideal for a wide range of purely architectural applications such as for grillework, screens, dividers, etc.

Figure 5:
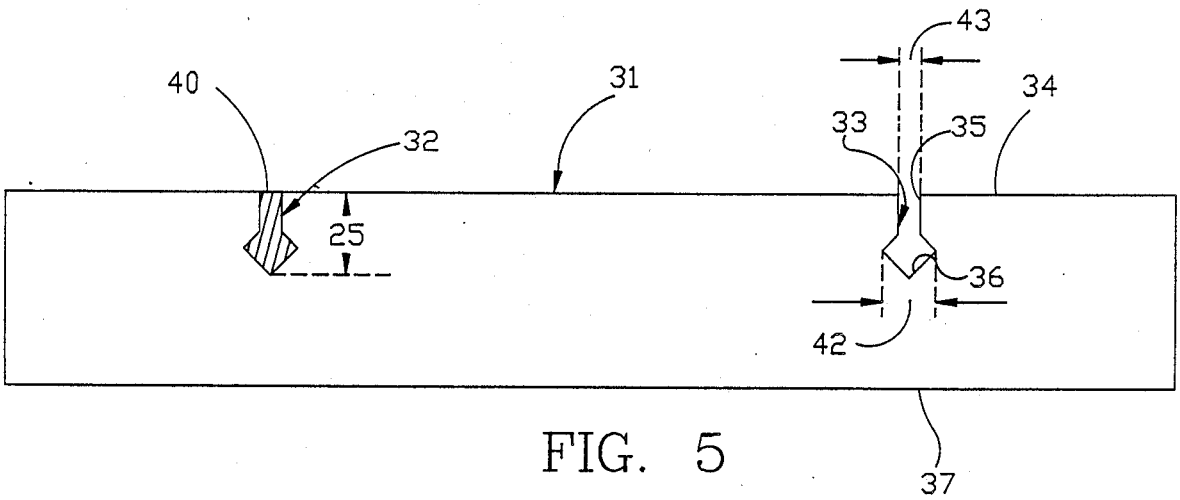
FIG. 5 is an enlarged, fragmentary side view of one grating bearing bars of the present invention.
Figure 6:
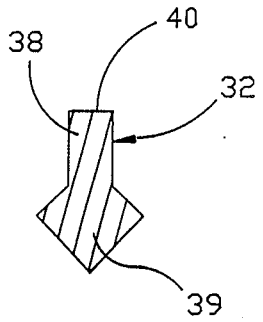
FIG. 6 is a greatly enlarged, transverse sectional view of one of the crossbars of the improved grating construction.

Grating construction 30 is comprised of a plurality of spaced, elongated, parallel bearing bars 31 and a plurality of spaced, parallel, transversely extending elongated, crossbars 32. Bearing bars 31 and crossbars 32 preferably are formed of aluminum or a material having similar properties of strength, rigidity , durability and resistance to harsh conditions. Each bearing bar 31 is generally flat and rectangular-shaped and has a plurality of spaced cutouts 33 formed along a longitudinal top edge 34 thereof, as best shown in FIG. 5. Each cutout 33 comprises an upper rectangular-shaped portion 35 and an enlarged outwardly flared generally square or diamond-shaped portion 36. The depth of cutout 33, indicated at 25, is approximately one-half the distance between top longitudinal edge 34 and a bottom longitudinal edge 37 of bearing bar 31. Each crossbar 32 has a generally rectangular-shaped top portion 38 and a generally square or diamond-shaped bottom or lower portion 39, wherein a transverse cross section of each of the crossbars is complementary in shape and size to cutouts 33, as shown in FIGS. 5 and 6.

Grating construction 30 is assembled in the following manner. Cutouts 33 are stamped in each bearing bar 31 in a manner well-known in the art, and the complementary-shaped crossbars 32 preferably are formed by extrusion when formed of aluminum, which is the preferred material of grating 30. Each crossbar 32 then is manually slideably engaged within a plurality of transversely aligned cutouts 33. The enlarged diamond-shaped lower portion 36 of each crossbar 32 then is deformed at 41, preferably by swaging by a plurality of dies on opposite sides of each of the cutouts 33 of the bearing bars which locks together the crossbars and bearing bars to form the grating (FIG. 4). More specifically, the swaging of the flared portion of the crossbar on opposite sides of each of the cutouts engaged by the crossbar deforms the crossbar and forces crossbar material into diamond-shaped portions 36 of cutouts 33 to securely lock together the crossbar and the bearing bars. In accordance with one of the main features of the invention, top surfaces 40 of rectangular portions 38 of crossbars 32 are substantially flush with longitudinal edges 34 of bearing bars 31 to provide a level surface for unobstructed walking or other movement on the grating. Furthermore, the formation of lower bearing bar cutout portion 36 so that its longitudinal length, indicated at 42 (FIG. 5), is greater than the longitudinal length 43 of upper rectangular portion 35, prevents the crossbars from becoming disengaged from the bearing bars.

In summary, grating 30 provides a strong, rigid and durable construction which is safe for use in structural applications yet attractive enough for use in architectural applications, which permits passage of adequate amounts of heat, light and air therethrough, and which is economical to manufacture and easy to maintain. In addition, grating assembly 30 is structurally sound due to the use of swaging for locking together the crossbars and bearing bars, and the lockingly engaged bars form a level, uniform grating surface for unobstructed walking or other movement on the grating. Furthermore, the positioning of the rectangular upper portion of the crossbars whereby top surfaces 40 are substantially flush with longitudinal edges 34 of the bearing bars provides for an appearance of greater strength and safety than if the crossbars are positioned below longitudinal edge 34 as in some prior art gratings, and particularly prior art grating construction of the type as shown in FIG. 2.

Figure 7:
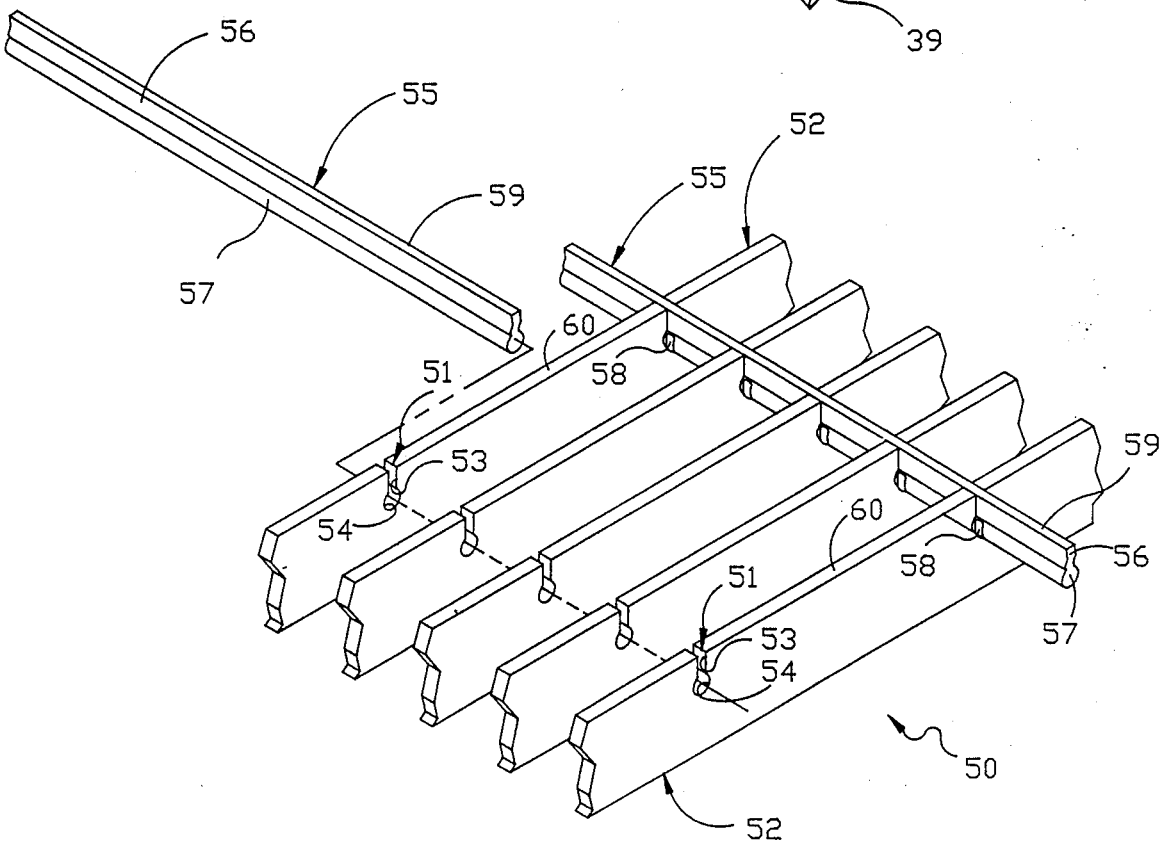
FIG. 7 is a partially exploded, fragmentary perspective view, of another embodiment of the improved grating construction.

A modification of grating construction 30 of the present invention is indicated generally at 50 and is shown in FIG. 7. Grating construction 50 is generally similar to grating construction 30 in its assembly construction and manner of fabrication, except for the following differences. Each cutout 51 of bearing bar 52 includes an upper rectangular portion 53 and an enlarged, generally circular-shaped lower portion 54 instead of the square or diamond-shaped portion 36 of grating 30. Thus, each crossbar 55 of grating 50 correspondingly includes a rectangular-shaped portion 56 and a circular-shaped lower portion 57 for slideable engagement within a plurality of transversely aligned complementary-shaped cutouts 51 formed in bearing bars 52.

Again, in order to achieve the securely locked crossbars 55 with the bearing bar cutouts, a pair of metal deformations 58 are formed in each crossbar on opposite sides of each bearing bar. Also, the diameter of circular-shaped portion 57 is larger than the longitudinal length of the upper rectangular portion 56 to prevent any upward movement of the crossbars from within cutouts 51 and more importantly to align top surface 59 of crossbars 55 with the top surfaces 60 of the bearing bars.

In the improved grating construction of the invention, metal deformations 41 and 58 only maintain the crossbars in proper position with the cutouts of the bearing bars by preventing transverse movement thereof. The enlarged bottom portions of the crossbars and their seating within the complementary-shaped and sized lower cutout portion prevent any upward or downward movement of the crossbars with respect to the bearing bars to insure that the top surfaces of the crossbars remain flush with the top surfaces of the bearing bars.

It is readily seen that other bearing bar cutout configurations and complementary cross-sectional configurations of the crossbar can be developed to achieve the results of the present invention and need not be limited to the two particular configurations described above. For example, an inverted T-shape and triangular bottom portion would provide generally similar results.

The main feature is the formation of the bottom cutout portion and corresponding bottom portion of the crossbar so that the crossbar is prevented from any upward or downward movement once it is slid transversely within the aligned cutouts. Also, the cutout and crossbar must be configured and sized so that when the crossbar is seated within the cutout the top surfaces or edges of the crossbar and bearing bar are flush.

Accordingly, the improved grating construction is simplified, provides an effective, safe, inexpensive and efficient construction which achieves all the enumerated objectives, provides for eliminating difficulties encountered with prior grating constructions, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved grating construction is constructed and used, the characteristics of the construction, and the advantageous, new and useful results obtained, the new and useful structures, devices, elements, arrangements, parts, and combinations, are set forth in the appended claims.

I claim:

1. An improved grating construction of the type intended for closing or flooring an opening, said grating including:

(a) a plurality of spaced, parallel, elongated aluminum bearing bars, each having a plurality of spaced cutouts formed along a longitudinal top edge thereof, said cutouts each comprising a generally rectangular-shaped upper portion and an outwardly flared lower portion;

(b) a plurality of spaced, parallel, elongated aluminum crossbars, each having a generally rectangular-shaped upper portion and an outwardly flared lower portion complementary in shape and size to the upper and lower portions, respectively, of the bearing bar cutouts, said crossbar being loosely slideably engaged within a plurality of transversely aligned bearing bar cutouts; and (c) deformations formed on certain of the outwardly flared lower portions of the aluminum crossbars adjacent to the aluminum bearing bars for locking the bearing bars with the crossbars so that an upper surface of the rectangular portions of the crossbars are generally flush with the longitudinal top edges of the bearing bars.

2. The construction defined in claim 1 in which each of the bearing bars is generally flat and rectangular-shaped.

3. The construction defined in claim 1 in which the outwardly flared lower portions of the cutouts and the complementary flared portions of the crossbars are generally diamond-shaped.

4. The construction defined in claim 1 in which the outwardly flared lower portions of the cutouts and the complementary flared portions of the crossbars are generally circular-shaped.

5. The construction defined in claim 1 in which the metal deformations of the crossbar is a swaged area on opposite sides of each of the cutouts engaged by the crossbar.

* * * * *